US008433215B2

(12) United States Patent
Tsujita

(10) Patent No.: US 8,433,215 B2
(45) Date of Patent: Apr. 30, 2013

(54) PRINTING CONTROL APPARATUS, PRINTING CONTROL METHOD, AND PROGRAM

(75) Inventor: Kosuke Tsujita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 300 days.

(21) Appl. No.: 12/684,593

(22) Filed: Jan. 8, 2010

(65) Prior Publication Data

US 2010/0196042 A1 Aug. 5, 2010

(30) Foreign Application Priority Data

Feb. 5, 2009 (JP) ..... 2009-025097

(51) Int. Cl.
*G03G 15/00* (2006.01)

(52) U.S. Cl.
USPC ..... 399/82

(58) Field of Classification Search ..... 399/33, 399/67, 69, 82, 83, 85, 87
See application file for complete search history.

(56) References Cited

U.S. PATENT DOCUMENTS 6,483,999 B1 * 11/2002 Andersen et al. ..... 399/87
2008/0030756 A1 * 2/2008 Carney et al. ..... 358/1.13

FOREIGN PATENT DOCUMENTS

JP 2001154536 A 6/2001
JP 2001356647 A 12/2001
JP 2002-123377 A 4/2002
JP 2005225039 A 8/2005
JP 2006172095 A 6/2006
JP 2007065577 A 3/2007

OTHER PUBLICATIONS

Japanese Office Action issued on Feb. 15, 2013, in counterpart Japanese Patent Application No. 2009-025097.

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A printing control apparatus that causes printing by a printing unit having a fixing unit that fixes a recording agent on a sheet, the printing control apparatus including: a printing control unit configured to cause the printing unit to stop printing of a currently printing job, and print another job in a state that printing of the job has been stopped; and a determining unit configured to determine whether or not to permit execution of the other job in a state that the currently printing job has been stopped by the printing control unit, based on a fixing unit temperature necessary for printing of the currently printing job and a fixing unit temperature necessary for execution of the other job.

11 Claims, 13 Drawing Sheets

FIG. 7

7001a

| | No. | INTERRUPTED JOB | INTERRUPTING JOB |
|---|---|---|---|
| 1002 | 1 | ORDINARY JOB | ORDINARY JOB |
| 1003 | 2 | GLOSSER PRE-PROCESSING JOB | GLOSSER PRE-PROCESSING JOB |

7001b

| | No. | INTERRUPTED JOB | INTERRUPTING JOB |
|---|---|---|---|
| 1004 | 1 | GLOSSER PRE-PROCESSING JOB | ORDINARY JOB |

PRINTING CONTROL APPARATUS, PRINTING CONTROL METHOD, AND PROGRAM

BACKGROUND OF THE INVENTION

1. Field of the Invention

The present invention relates to a printing control apparatus, a printing control method, and a program.

2. Description of the Related Art

Printing control apparatuses having an interrupt function are known from the conventional technology. In this type of printing control apparatus, when an interrupting job is received, regardless of the sort of document of the interrupted job that is being printed, printing is temporarily stopped, and a change is made to printing of the document of the interrupting job. A problem has been pointed out that as a result, when the number of output pages of the interrupting job is very high, the user who is printing the interrupted job is made to wait, with printing of the interrupted job not ever finishing, for as long as it takes to print the interrupting job.

As technology addressing this problem, there has been proposed technology in which control is performed such that when an interrupt instruction has been received from a host computer during printing processing, both documents are alternately output based on a fixed ratio (see Japanese Patent Laid-Open No. 2002-123377). This technology eliminates a circumstance in which an interrupt document having many pages that has been designated for interrupt printing is given priority, and printing output of a preceding document having few pages is delayed.

On the other hand, as an example of a printing system in which the added value of a printed item is increased, there is a printing system in which gloss processing is performed that gives a glossy finish to a printing face. As an example of a method for performing gloss processing, there is a method in which a glosser is used, the glosser being one type of offline finisher. The glosser, by applying pressure and heat to a printed item, temporarily melts the surface of toner fixed to the paper face, and by afterward cooling that surface while applying pressure on a belt, smoothes the surface portion of the toner like a mirrored face, and thus is able to give a gloss effect to the paper face. Incidentally, when printing is performed in which a gloss effect is given by using a glosser, in the printing apparatus, it is necessary that toner is weakly fixed to the printed item applied to the glosser (below, this processing is referred to as glosser pre-processing). The reason for this is that toner is made more easily melted when the gloss effect is applied in the glosser. In order to perform glosser pre-processing, it is necessary to reduce the toner fixing temperature in the printing apparatus by about 40 degrees from the ordinary fixing temperature (about 200 degrees), and this ordinarily requires a time period of about 7 to 10 minutes.

However, with a printing control apparatus capable of interrupt printing control, for example, during execution of a job, when performing interrupt printing of a job that requires a different temperature than the job currently being executed, it takes time to change the temperature of a fixing unit. For example, when, during execution of a job in which toner is fixed at 200 degrees, interrupt printing of a job is performed in order to perform glosser pre-processing in which toner is fixed at 160 degrees, a user is required to wait for the temperature of the fixing unit to decrease.

Moreover, after execution of the interrupting job in which glosser pre-processing is performed, the job that was stopped due to the interruption is restarted, and in this case, it is necessary for the temperature of the fixing unit to be increased from 160 degrees to 200 degrees.

SUMMARY OF THE INVENTION

The present invention was made in order to address the problems described above. The present invention suppresses a decrease in job productivity that occurs due to interrupting a job that is currently printing with execution of a job that requires a different fixing unit temperature than the job that is currently printing.

According to one aspect of the present invention, there is provided a printing control apparatus that causes printing by a printing unit having a fixing unit that fixes a recording agent on a sheet, the printing control apparatus comprising: a printing control unit configured to cause the printing unit to stop printing of a currently printing job, and print another job in a state that printing of the job has been stopped; and a determining unit configured to determine whether or not to permit execution of the other job in a state that the currently printing job has been stopped by the printing control unit, based on a fixing unit temperature necessary for printing of the currently printing job and a fixing unit temperature necessary for execution of the other job; wherein the printing control unit performs control such that the other job is executed in a state that the currently printing job has been stopped when the determining unit determines to permit execution of the other job in a state that the currently printing job has been stopped, and the other job is not executed in a state that the currently printing job has been stopped when the determining unit determines not to permit execution of the other job in a state that the currently printing job has been stopped.

According to another aspect of the present invention, there is provided a method for performing printing control to cause printing by a printing unit having a fixing unit that fixes a recording agent on a sheet, the method comprising: a printing control step of causing the printing unit to stop printing of a currently printing job, and print another job in a state that printing of the job has been stopped; and a determining step of determining whether or not to permit execution of the other job in a state that the currently printing job has been stopped in the printing control step, based on a fixing unit temperature necessary for printing of the currently printing job and a fixing unit temperature necessary for execution of the other job; wherein in the printing control step, control is performed such that the other job is executed in a state that the currently printing job has been stopped when a determination has been made in the determining step to permit execution of the other job in a state that the currently printing job has been stopped, and the other job is not executed in a state that the currently printing job has been stopped when a determination has been made in the determining step not to permit execution of the other job in a state in which the currently printing job has been stopped.

According to the present invention it is possible to suppress a decrease in job productivity that occurs due to interrupting a job that is currently printing with execution of a job that requires a different fixing unit temperature than the job that is currently printing.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7 shows examples of an interrupt permission table used in a printing apparatus serving as an embodiment of the present invention.

DESCRIPTION OF THE EMBODIMENTS

Following is a detailed description of an exemplary embodiment of the invention with reference to the attached drawings. However, the constituent elements described in this embodiment are to be considered in all respects as illustrative and not limiting of the scope of the invention.

(System Configuration)

Figure 1:
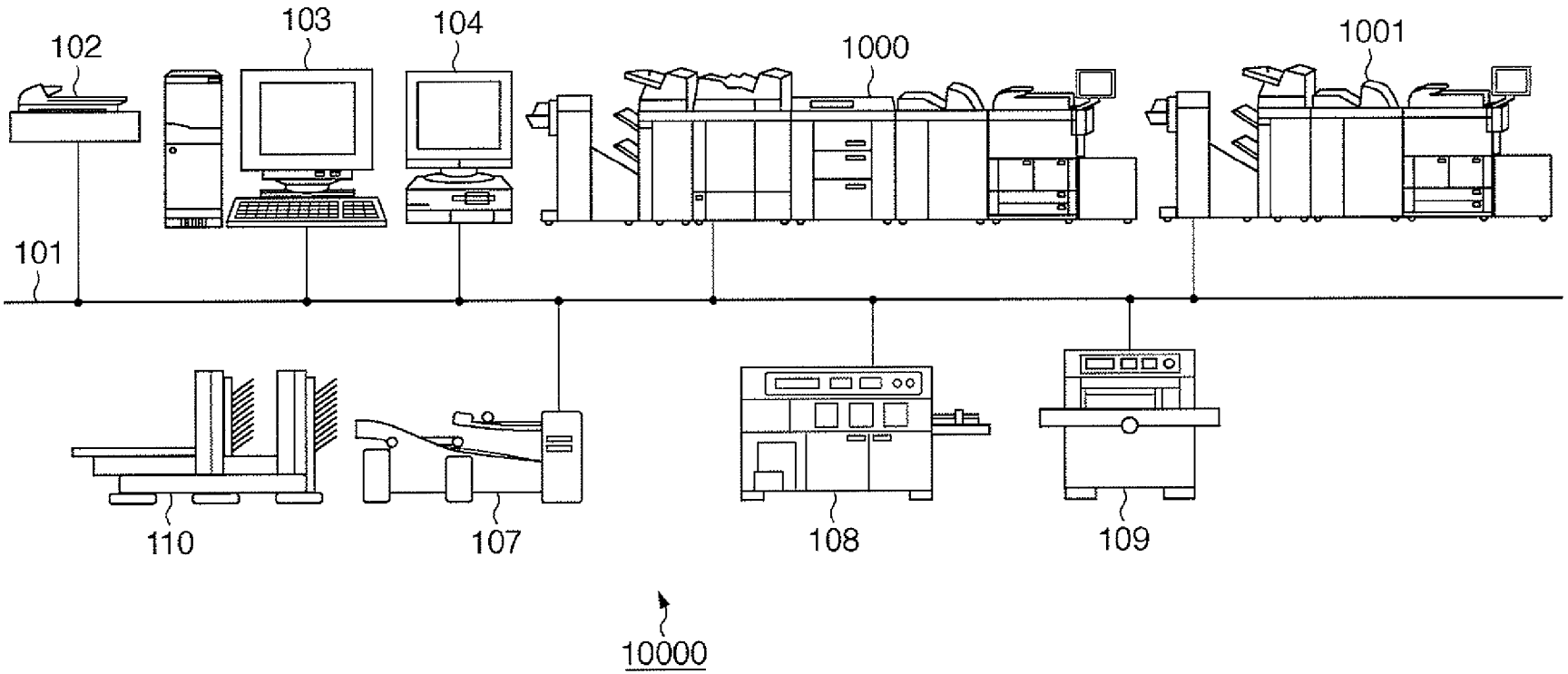
FIG. 1 illustrates an example overall configuration of a POD system that includes a printing apparatus serving as an embodiment of the present invention.

FIG. 1 shows the general configuration of a system having a printing apparatus that is an example of a printing control apparatus serving as an embodiment of the present invention. A POD system 10000 includes printing systems 1000 and 1001, a scanner 102, a server computer 103, and a client computer 104, and these are connected via a network 101. Within this network, the POD system 10000 has a sheet folding apparatus 107, a trimmer 109, a saddle stitching apparatus 110, and a case binding apparatus 108.

The server computer 103 manages sending and receiving of data to/from the various apparatuses connected to the network 101. The client computer 104 sends image data via the network 101 to the printing systems 1000 and 1001 and the server computer 103. The sheet folding apparatus 107 performs folding processing of sheets that have been printed with the printing systems 1000 and 1001. The case binding apparatus 108 performs case binding processing of sheets that have been printed with the printing systems 1000 and 1001. The trimmer 109 performs trimming processing of sheets that have been printed with the printing systems 1000 and 1001, for each of sheet bundles comprised of a plurality of sheets. The saddle stitching apparatus 110 performs saddle stitching processing of sheets that have been printed with the printing systems 1000 and 1001.

When using the sheet folding apparatus 107, the case binding apparatus 108, the trimmer 109, or the saddle stitching apparatus 110, the user retrieves sheets that have been printed with the printing systems 1000 and 1001, places those sheets in the apparatus to be used, and causes execution of processing by that apparatus. Among the plurality of apparatuses in the POD system 10000 in FIG. 1, apparatuses other than the saddle stitching apparatus 110 are connected to the network 101, and are capable of performing data communications with another apparatus.

Figure 2:
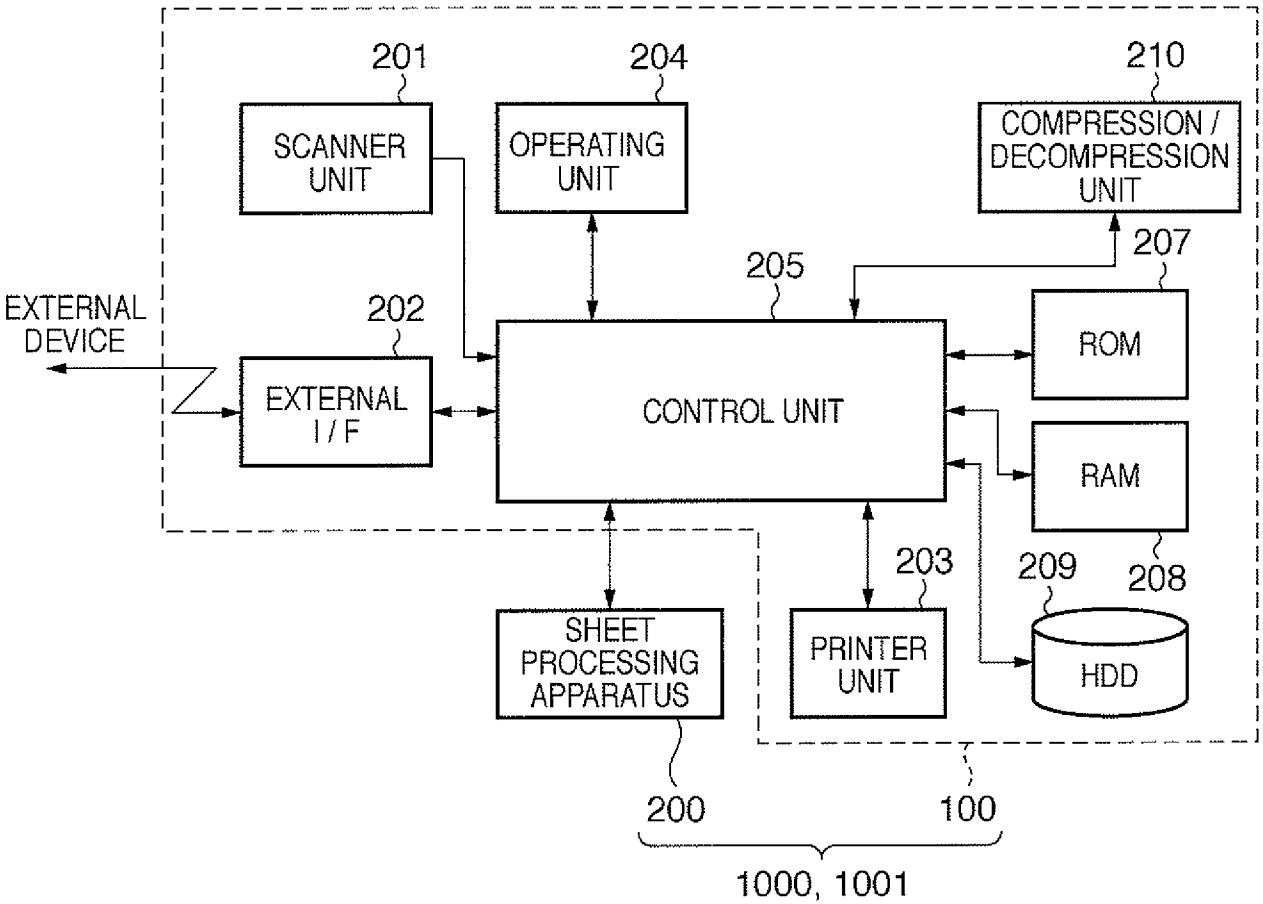
FIG. 2 shows the configuration of a printing system that includes a printing apparatus serving as an embodiment of the present invention.

FIG. 2 shows the internal configuration of the printing systems 1000 and 1001. In the present embodiment, the printing system 1001 has the same configuration as the printing system 1000. The printing systems 1000 and 1001 have a printing apparatus 100 and a sheet processing apparatus 200. The printing apparatus 100 serving as the present embodiment is a MFP (Multi Function Peripheral) that has a plurality of functions, such as a copy function and a printer function. However, this is not a limitation of the present invention; a single function apparatus having only a copy function or only a printer function may also be adopted as the printing apparatus 100.

Among the respective units included in the printing system 1000, units other than the sheet processing apparatus 200 are included in the printing apparatus 100. An arbitrary number of sheet processing apparatuses 200 can be connected to the printing apparatus 100.

The printing systems 1000 and 1001 are configured such that sheet processing of sheets that have been printed with the printing apparatus 100 can be executed by a sheet processing apparatus 200 connected to the printing apparatus 100. However, it is also possible to configure the printing system 1000 with only the printing apparatus 100, without connecting a sheet processing apparatus 200.

Figure 4:
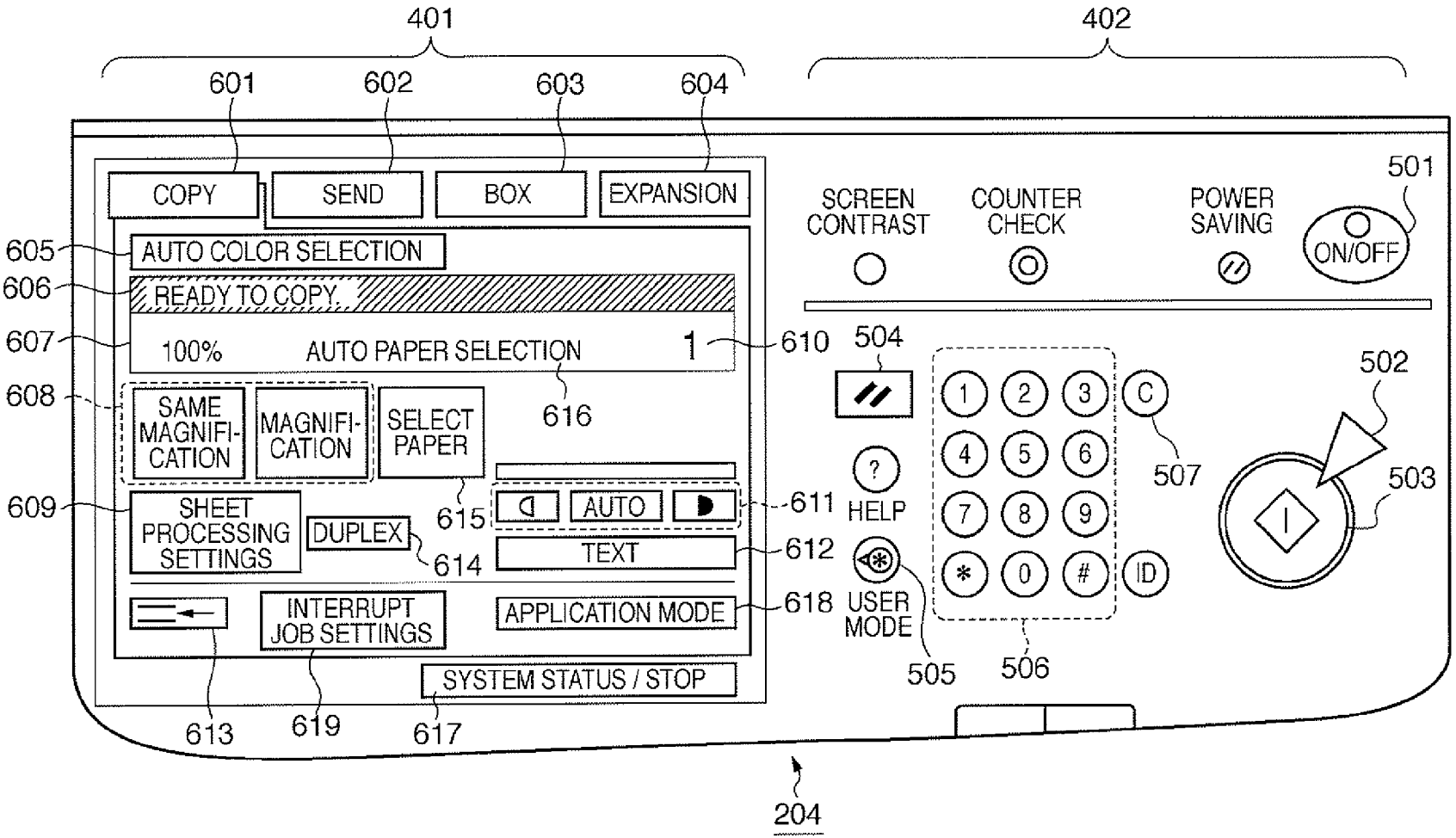
FIG. 4 shows the configuration of a user interface of a printing apparatus serving as an embodiment of the present invention.

The sheet processing apparatus 200 is configured so as to be capable of communications with the printing apparatus 100, and can receive instructions from the printing apparatus 100 and execute sheet processing. A scanner unit 201 reads an image on an original, converts the read image to image data, and transfers the image data to another unit. An external I/F 202 sends and receives data to/from another apparatus connected to the network 101. A printer unit 203 prints an image on a sheet based on image data that has been input. An operating unit 204 has a hard key input unit (key input unit) 402 and a touch panel unit 401 as shown in FIG. 4, and receives instructions from a user via these units.

A control unit 205 performs central control of processing, operation, and so forth of the various units in the printing systems 1000 and 1001. For example, the control unit 205 controls operation of the printing apparatus 100 and the sheet processing apparatus 200 connected to the printing apparatus 100. A ROM 207 stores various computer programs executed by the control unit 205. For example, the ROM 207 stores programs for allowing the control unit 205 to execute various processing shown in flowcharts described below, and a display control program necessary for displaying various settings screens described below. Also, the ROM 207 stores a program for executing operation whereby the control unit 205 interprets PDL (Page Description Language) code data received from the server computer 103, the client computer 104, or the like, and opens this data as raster image data. Also, the ROM 207 stores boot sequence and font information, and the like. A RAM 208 stores image data that has been forwarded from the scanner unit 201 or the external I/F 202, and various programs and settings information loaded from the ROM 207. Also, the RAM 208 stores information related to the sheet processing apparatus 200 (such as the number (from 0 to n apparatuses) of sheet processing apparatuses 200 connected to the printing apparatus 100, information related to the function of each sheet processing apparatus 200, the connection order of the sheet processing apparatuses 200, and so forth).

An HDD (hard disk drive) 209 is comprised of a hard disk, a drive unit or the like that performs reading/writing of data from/to the hard disk, and so forth. The HDD 209 is a large-volume storage apparatus for storing image data that has been input from the scanner unit 201 or the external I/F 202 and compressed by a compression/decompression unit 210. The HDD 209 is capable of storing, as a job, received image data along with associated print settings received via the operating unit 204, and is capable of holding a plurality of jobs to be executed. The control unit 205, based on an instruction from the user, is capable of printing image data stored in the HDD 209 with the printer unit 203. Also, the control unit 205, based on an instruction from the user, is capable of sending image data stored in the HDD 209 to an external apparatus such as the server computer 103, the printing systems 1000 and 1001, or the like via the external I/F 202. Also, the control unit 205 is likewise capable of acquiring image data from an external apparatus such as the server computer 103, the printing systems 1000 and 1001, or the like via the external I/F 202. The control unit 205 is also capable of searching for an external apparatus connected to the network 101 via the external I/F 202. The compression/decompression unit 210 performs an operation of compressing or decompressing image data or the like stored in the RAM 208 or the HDD 209 using various compression formats, such as JBIG or JPEG.

Figure 3:
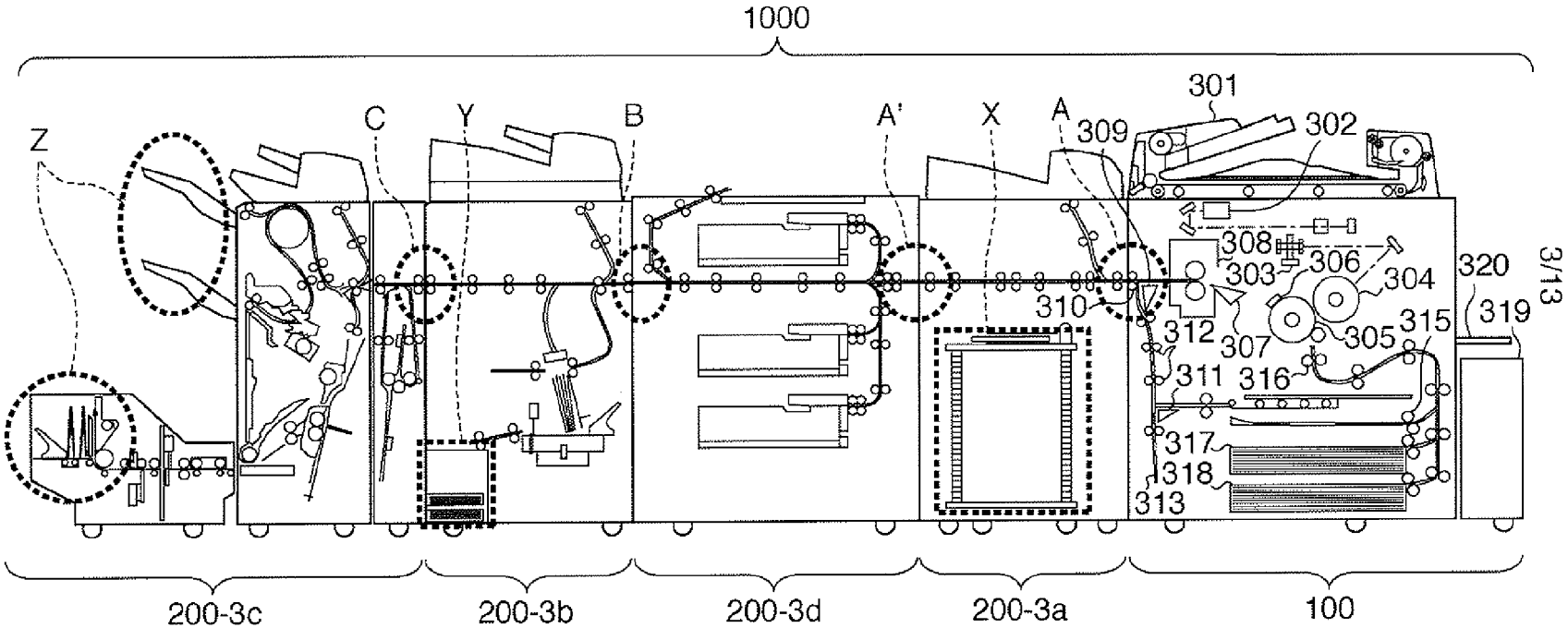
FIG. 3 shows the configuration of a printing system that includes a printing apparatus serving as an embodiment of the present invention.

Next, the internal configuration of the printing system 1000 will be described with reference to FIG. 3. FIG. 3 is a schematic cross-sectional view of the printing apparatus 100 and the sheet processing apparatuses 200 connected to the printing apparatus 100.

An automatic document feeder (ADF) 301 separates, in order, a batch of originals that have been placed on a loading face of an original tray, in page order beginning from the original of the first page, and transports the separated originals onto an original platen glass for a scanning unit 302 to perform original scanning. The scanning unit 302 reads an image of an original that has been transported onto the original platen glass, and uses a CCD to convert the read image to image data. A rotating polygon mirror 303 or the like causes a light beam that has been modulated according to the image data, for example a laser beam or the like, to be incident on a photosensitive drum 304 as reflected scanning light via a reflecting mirror. A latent image formed by the laser light on the photosensitive drum 304 is developed using a toner, and the resulting toner image is transferred to a sheet material applied onto a transfer drum 305. By sequentially executing this one iteration of an image forming process for yellow (Y), magenta (M), cyan (C), and black (K) toners, a full color image is formed. After four iterations of the image forming process, the sheet material on the transfer drum 305, on which a full color image has been formed, is separated by a separation pawl 306 and transported to a fixing unit 308 by a pre-fixing transport unit 307. The fixing unit 308 is comprised of a combination of rollers and belts, has a built-in heat source such as a halogen heater, and applies heat and pressure to the toner on the sheet material to which the toner image has been transferred in order to melt and fix that toner. A discharge flapper 309 is capable of swinging around a swinging shaft to regulate the transport direction of the sheet material. When the discharge flapper 309 is swung in the clockwise direction in FIG. 3, the sheet material is transported straight and discharged out of the apparatus by discharge rollers 310.

On the other hand, when forming an image on both faces of the sheet material, the discharge flapper 309 swings in the counterclockwise direction in FIG. 3, and so the path of the sheet material is changed to the downward direction and the sheet material is fed into a duplex transport unit. The duplex transport unit is provided with a reverse flapper 311, reverse rollers 312, a reverse guide 313, and a duplex tray 314. The reverse flapper 311 regulates the transport direction of the sheet material by swinging around a swinging shaft.

When processing a duplex print job, after printing to a first face of a sheet, the reverse flapper 311 is swung in the counterclockwise direction in FIG. 3, and that sheet is fed into the reverse guide 313 via the reverse rollers 312. Next, with the trailing end of the sheet material sandwiched between the reverse rollers 312, the reverse rollers 312 are temporarily stopped, and then the reverse flapper 311 is swung in the clockwise direction in FIG. 3. Also, the reverse rollers 312 are rotated in the reverse direction. Thus, the sheet is switched back and transported, and with the trailing end and the leading end of the sheet switched, control is performed to guide the sheet to the duplex tray 314. Sheet material is temporarily stacked in the duplex tray 314, and afterward the sheet material is again fed into registration rollers 316 by resupply rollers 315. At this time, the sheet material is being fed in a state in which the opposite face as in the transfer process for the first face is the side facing the photosensitive drum. Then, in the same manner as in the process described above, an image for the second face of the sheet is formed on that second face. After image forming and the fixing process are performed on both faces of the sheet material, the sheet is discharged from within the main body of the printing apparatus 100 to outside of the apparatus via the discharge rollers 310.

The printing apparatus 100 has supply units where sheets needed for print processing are stored. Among the supply units are paper cassettes 317 and 318 (for example, each capable of storing 500 sheets), a paper deck 319 (for example, capable storing 5000 sheets), a manual tray 320, and so forth. Various sheets of different sizes and materials can be placed in the paper cassettes 317 and 318 and the paper deck 319, distinguished by the supply unit in which the sheets are placed. Various sheets, including specialized sheets such as OHP sheets, can be placed in the manual tray 320. Supply rollers are provided in each of the paper cassettes 317 and 318, the paper deck 319, and the manual tray 320, and sheets are continuously supplied page-by-page by the supply rollers.

Next is a description of the sheet processing apparatuses 200. As long as the printing apparatus 100 can transport a sheet from an upstream apparatus to a downstream apparatus via a sheet transport path, it is possible to adopt an arbitrary number of joined apparatuses of an arbitrary type as the sheet processing apparatuses 200. Here, as shown in FIG. 3, a large-volume stacker 200-3*a*, an inserter 200-3*d*, a glue binding apparatus 200-3*b*, and a saddle stitching apparatus 200-3*c* are joined in order beginning closest to the printer apparatus 100, and these can be selectively used by the printing system 1000. Also, each sheet processing apparatus 200 is provided with a sheet discharge unit, and the user can retrieve a sheet for which sheet processing has been performed from the sheet discharge unit of each sheet processing apparatus.

Above, the printing mechanism of the printing system 1000 was described, but the respective configuration included here are controlled by the control unit 205 shown in FIG. 2. For example, the control unit 205 receives a request to execute a type of sheet processing desired by the user from among candidates for sheet processing of types that can be executed by the sheet processing apparatuses 200 connected to the printing apparatus 100, along with a printing execution request, via the operating unit 204. In response to receiving from the user a request to execute printing of a processing target job via the operating unit 204, the control unit 205 causes the printer unit 203 to execute print processing needed for that job. Then, the control unit 205 causes sheets of the job for which this print processing has been performed to be transported via the transport path to the sheet processing apparatus that can execute the sheet processing desired by the user, and causes the sheet processing apparatus to execute the sheet processing.

Also, for example, it is assumed that a processing target job for which a printing execution request was received from the user is a job for which the user has instructed large-volume stacking processing to be performed by the large-volume stacker 200-3*a*. This job is called a "stacker job". When this stacker job is processed in the system configuration shown in FIG. 3, the control unit 205 shown in FIG. 2 causes sheets of this job that have been printed by the printing apparatus 100 to be transported past point A in FIG. 3 and into the large-volume stacker 200-3*a*. Afterward, the control unit 205 causes stacking processing for this job to be executed by the large-volume stacker 200-3*a*. Then, the control unit 205, without causing printed items for this job for which stacking processing has been performed by the large-volume stacker 200-3*a* to be transported to another apparatus (for example, an apparatus in a later stage), causes these printed items to be held at a discharge destination X within the large-volume stacker 200-3*a*.

The printed items of the stacker job that have been held at the discharge destination X in FIG. 3 can be directly retrieved by the user from the location of the discharge destination X. Thus, a sequence of apparatus operation and operation by the user, such as transporting sheets to a discharge destination Z in FIG. 3 that is furthest downstream in the sheet transport direction and retrieving printed items of the stacker job from the discharge destination Z, is unnecessary.

Also, it is assumed that a processing target job for which a printing execution request was received from the user in the system configuration in FIG. 3 is a job for which the user has instructed sheet processing to be performed by the glue binding apparatus 200-3*b* (for example, glue binding processing of either case binding processing or pad binding processing). This job is called a "glue binding job".

When this glue binding job is processed in the system configuration in FIG. 3, the control unit 205 causes sheets that have been printed by the printing apparatus 100 to be transported via points A, A', and B in FIG. 3 into the glue binding apparatus 200-3*b*. Afterward, the control unit 205 causes glue binding processing for this job to be executed by the glue binding apparatus 200-3*b*. Then, the control unit 205, without causing printed items for this job for which glue binding processing has been performed by the glue binding apparatus 200-3*b* to be transported to another apparatus (for example, an apparatus in a later stage), causes these printed items to be held as-is at a discharge destination Y within the glue binding apparatus 200-3*b*.

Furthermore, for example, it is assumed that a processing target job for which a printing execution request was received from the user in the system configuration in FIG. 3 is a job for which the user has instructed sheet processing to be performed by the saddle stitching apparatus 200-3*c*. Sheet processing by the saddle stitching apparatus 200-3*c* includes, for example, saddle stitching, punch processing, trimming processing, shift discharge processing, folding processing, and so forth. Here, this job is called a "saddle stitching job".

When this saddle stitching job is processed in the system configuration in FIG. 3, the control unit 205 causes sheets of this job that have been printed by the printing apparatus 100 to be transported past points A, A', B, and C to the saddle stitching apparatus 200-3*c*. Afterward, the control unit 205 causes sheet processing for this job to be executed by the saddle stitching apparatus 200-3*c*. Then, the control unit 205 causes printed items of the saddle stitching job for which sheet processing has been performed by the saddle stitching apparatus 200-3*c* to be held at a discharge destination Z of the saddle stitching apparatus 200-3*c*.

Note there are a plurality of discharge destination candidates for the discharge destination Z. This is because it is possible for the saddle stitching apparatus 200-3*c* to execute a plurality of types of sheet processing, and these discharge destination candidates are used when adopting a different discharge destination for each type of sheet processing. In the printing system 1000 described with reference to FIG. 3, the user can cause glosser pre-processing to be performed.

Here, the glosser pre-processing will be described.

When it is desired to make a printed item glossy, the user can confer gloss by causing gloss processing of a printed sheet to be performed by an apparatus such as a glosser. Gloss processing is processing in which, by applying pressure and heat to a printed item, the surface of toner fixed to the paper face is temporarily melted, and by afterward cooling that surface while applying pressure on a belt, the surface portion of the toner is smoothed like a mirrored face. Thus it is possible to give a gloss to the sheet surface. Also, in the case of a glosser having a function to print a transparent toner, it is possible to strengthen the gloss of a sheet that has been smoothed by applying transparent toner to the surface of the sheet.

When causing gloss processing to be performed on a sheet by a glosser in this way, in the printing system 1000, it is necessary to cause the printing system to weakly fix the toner to the printed item (temporary fixing) as glosser pre-processing in a stage prior to gloss processing. The reason for this is that toner is made more easily melted when the gloss effect is applied by the glosser. Therefore, in the printing system 1000, as glosser pre-processing, the toner fixing temperature is reduced by about 40 degrees from the ordinary fixing temperature (about 200 degrees), and then fixing is performed.

The user places a printed item to which toner has been fixed by executing the glosser pre-processing in a supply unit of the glosser, and then causes gloss processing to be performed. The glosser, by applying pressure and heat to the printed item, temporarily melts the surface of the toner that has been fixed to the paper face. Then, by cooling the printed item while applying pressure to the printed item, the glosser smoothes the surface of the toner like a mirrored face. Also, when the user has instructed transparent toner to be applied, transparent toner is applied to the sheet whose toner surface has been smoothed.

Here, a case of performing gloss processing with a dedicated glosser was described, but a configuration may also be adopted in which the printing system 1000 executes the gloss processing, if the printing system 1000 is provided with the functions of a glosser that transfers transparent toner to a sheet and fixes that toner to the sheet. In this case, the user may place printed sheets in a supply unit of the printing system 1000, and give an instruction for gloss processing to be executed. Thus, the printing system 1000 can supply sheets from the supply unit, and give a gloss to the sheets by performing the same processing as the glosser.

Next is a description of the configuration of the operating unit 204 with reference to FIG. 4. The operating unit 204 is provided with the touch panel unit 401 and the key input unit 402. The touch panel unit 401 is comprised of an LCD (Liquid Crystal Display) and transparent electrodes applied on the LCD. The touch panel unit 401 displays various settings screens for receiving instructions from the user. The touch panel unit 401 is provided with both a function to display various screens and an instruction input function to receive instructions from the user. The key input unit 402 is provided with a power key 501, a start key 503, a stop key 502, a user mode key 505, and a numeric keypad 506. The start key 503 is used when causing the printing apparatus 100 to start execution of a copy job or a send job. The numeric keypad 506 is used when performing settings of numerical input such as a number of copies to print.

The control unit 205 controls the printing system 1000 to perform various processing based on a user instruction received via various screens displayed in the touch panel unit 401, or based on a user instruction received via the key input unit 402.

Figure 5:
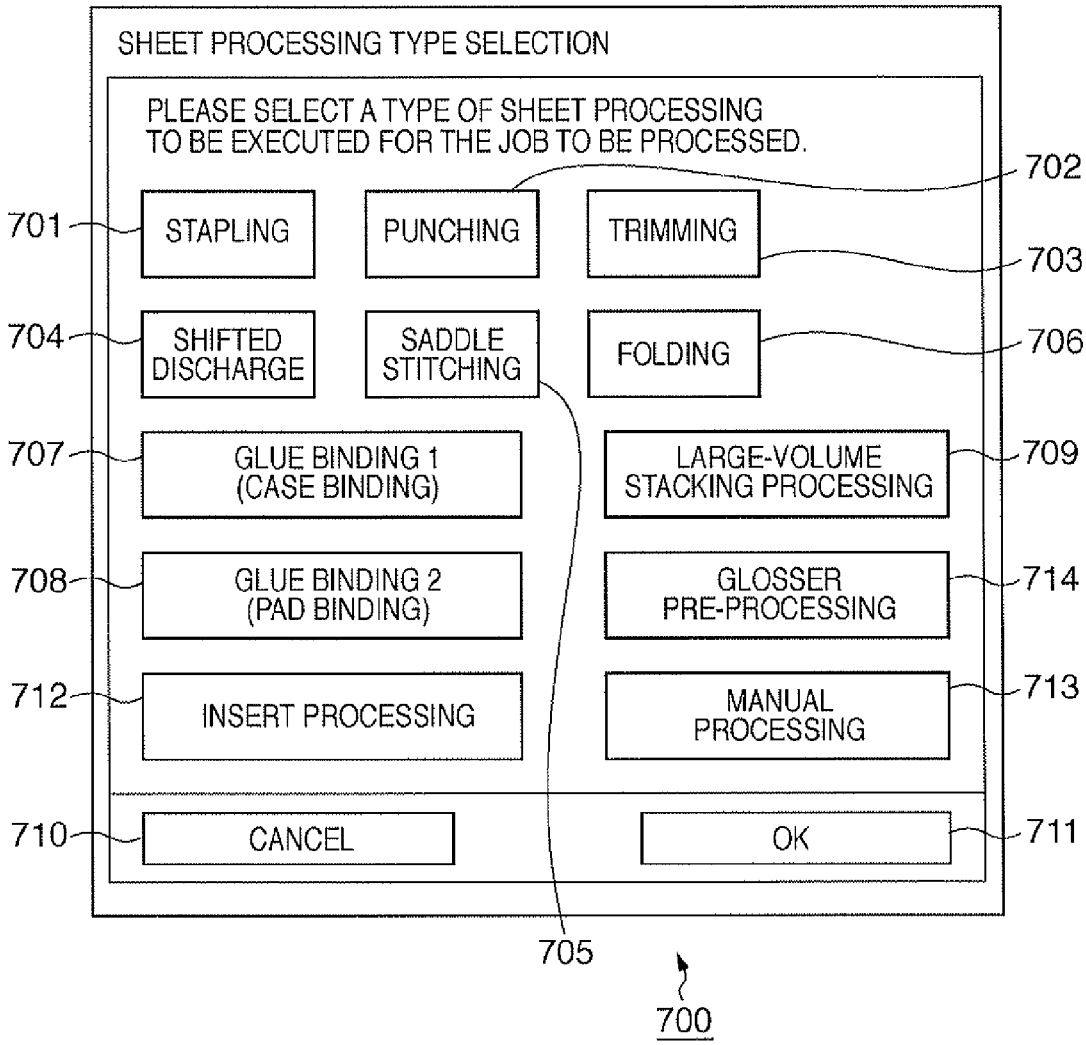
FIG. 5 shows the configuration of a user interface of a printing apparatus serving as an embodiment of the present invention.

FIG. 5 shows an example display of a settings screen for allowing the user to select a type of sheet processing to be executed on a sheet that has been printed by the printing apparatus 100. When the user presses a sheet processing settings key 609, shown in FIG. 4, on the screen displayed in the touch panel unit 401, the control unit 205 causes the touch panel unit 401 to display the screen in FIG. 5. The screen in FIG. 5 is a settings screen configured to enable the user to select a type of sheet processing that can be executed using the sheet processing apparatuses 200 included in the printing system 1000. The control unit 205 receives setting of the sheet processing to be executed in the processing target job from the user via the screen in FIG. 5, and causes a sheet processing apparatus 200 to execute sheet processing according to the setting.

For example, when a setting has been set to perform stapling with a staple key 701, the control unit 205 performs control such that stapling of sheets that have been printed by the printing apparatus 100 is performed by the saddle-stitching apparatus 200-3*c*. When a setting has been set to perform punching (hole forming) with a punch key 702, the control unit 205 performs control such that punching of sheets that have been printed by the printing apparatus 100 is performed by the saddle-stitching apparatus 200-3*c*. When a setting has been set to perform glosser pre-processing with a glosser pre-processing key 714, when executing the job for which that setting was set, the control unit 205 performs control such that fixing is performed with the fixing temperature of the fixing unit 308 lowered about 40 degrees from the ordinary fixing temperature. In the case of other keys as well, the control unit 205 performs control such that processing corresponding to the key set by the user is performed in the printing system 1000.

Note that in the present embodiment, an example configuration is described in which the operating unit 204 is provided in the printing apparatus 100, as one example of a user interface unit applied in the printing system 1000, but a different configuration may also be adopted. For example, a configuration may be adopted in which processing based on an instruction from a user interface unit provided in an external apparatus such as the server computer 103 or the client computer 104 can be executed by the printing system 1000. In such a configuration, when the printing system 1000 is remotely operated from the external apparatus, a settings screen related to the printing system 1000 is displayed in a display unit of that apparatus.

Following is a description of an example using the client computer 104. When a CPU provided in the client computer 104 has received a print request from the user, a settings screen is displayed in a display, and settings for print processing conditions are received from an operator of the client computer 104 via this screen. When a printing execution request has been received from the operator, the CPU provided in the client computer 104 associates the print processing conditions received via this screen with the image data to be printed. Then, the CPU performs control to send these conditions and the image data together as one job to the printing system 1000 via the network 101.

On the other hand, in the printing system 1000, when a printing execution request for this job is received via the external I/F 202, the control unit 205 controls the printing system 1000 such that processing is performed based on the print processing conditions from the client computer 104.

In the printing system 1000 as described above, the user can use an interrupt function. The interrupt function is a function whereby the control unit 205 of the printing system 1000 temporarily stops a job that is currently printing, and executes another job with priority. By using this interrupt function, the user can cause the printing system 1000 to execute a job that the user wishes to quickly execute, and obtain the printed items of that job.

The control unit 205 of the printing system 1000 can execute a plurality of types of jobs.

Among the jobs that the printing system 1000 can execute is a copy job, in which an image that has been read by the scanner unit 201 is printed by the printer unit 203. Also, there is a print job, in which image data received by the external I/F 202 is printed by the printer unit 203. In the present embodiment, these jobs are collectively referred to as ordinary jobs. When executing an ordinary job, the control unit 205 sets the temperature of the fixing unit to Ta. In the case of plain paper, the value of Ta is preferably about 200 degrees, but the control unit 205 may set an optimal temperature according to the amount of toner that will be printed.

Also, the control unit 205 can execute a job in which glosser pre-processing is performed (a glosser pre-processing job). In a glosser pre-processing job as well, as in the case of an ordinary job, an image that has been read by the scanner unit 201 is printed by the printer unit 203, or image data received by the external I/F 202 is printed by the printer unit 203. However, when executing a glosser pre-processing job, unlike in the case of an ordinary job, the control unit 205 sets the temperature of the fixing unit to Tb, which is about 40 degrees lower than Ta. That is, when a glosser pre-processing job is executed on plain paper, the control unit 205 sets the temperature of the fixing unit to about 160 degrees. It is desirable that the value of Tb also is adjusted according to the type of paper and the amount of toner.

Thus, the control unit 205 can execute printing at a fixing unit temperature that is appropriate for an ordinary job or a glosser pre-processing job, respectively.

Also, in response to an instruction from the user, while a particular job is being executed, the control unit 205 can cause another job to be executed with priority. For example, it is possible to interrupt an ordinary job with another ordinary job, or it is possible to interrupt a glosser pre-processing job with another glosser pre-processing job.

However, the control unit 205 prevents interrupting an ordinary job with a glosser pre-processing job. This is because in order to change the temperature Ta for an ordinary job to the temperature Tb for a glosser pre-processing job, it is necessary to cool the fixing unit, and a time t1 (about 7 to 10 minutes) is needed for this cooling.

Also, the control unit 205 prohibits interruption with an ordinary job while a glosser pre-processing job is being executed. A time t2 for changing the temperature Tb for a glosser pre-processing job to the temperature Ta for an ordinary job is shorter than the time T1 for changing the fixing unit from the temperature Ta to Tb. However, after executing an ordinary job that was interjected, when resuming a glosser pre-processing job that was stopped, this resuming requires the time t2 needed to change the fixing unit from the temperature Ta to Tb.

A table containing settings of whether such interruption is permitted or prohibited is stored in the HDD 209, and the control unit 205 determines whether to permit or prohibit interruption based on this table.

Due to performing control as described above, the user is able to cause the printing system 1000 to use the interrupt function to print a printed item that the user wishes to have output quickly. Also, it is possible to prevent execution of a glosser pre-processing job using the interrupt function while an ordinary job is being executed, taking time for cooling of the fixing unit and thus reducing job productivity. Furthermore, it is possible to prevent execution of an ordinary job using the interrupt function while a glosser pre-processing job is being executed, taking time for cooling of the fixing unit after execution of the ordinary job and thus reducing job productivity.

(Basic Interrupt Control Method)

Figure 6:
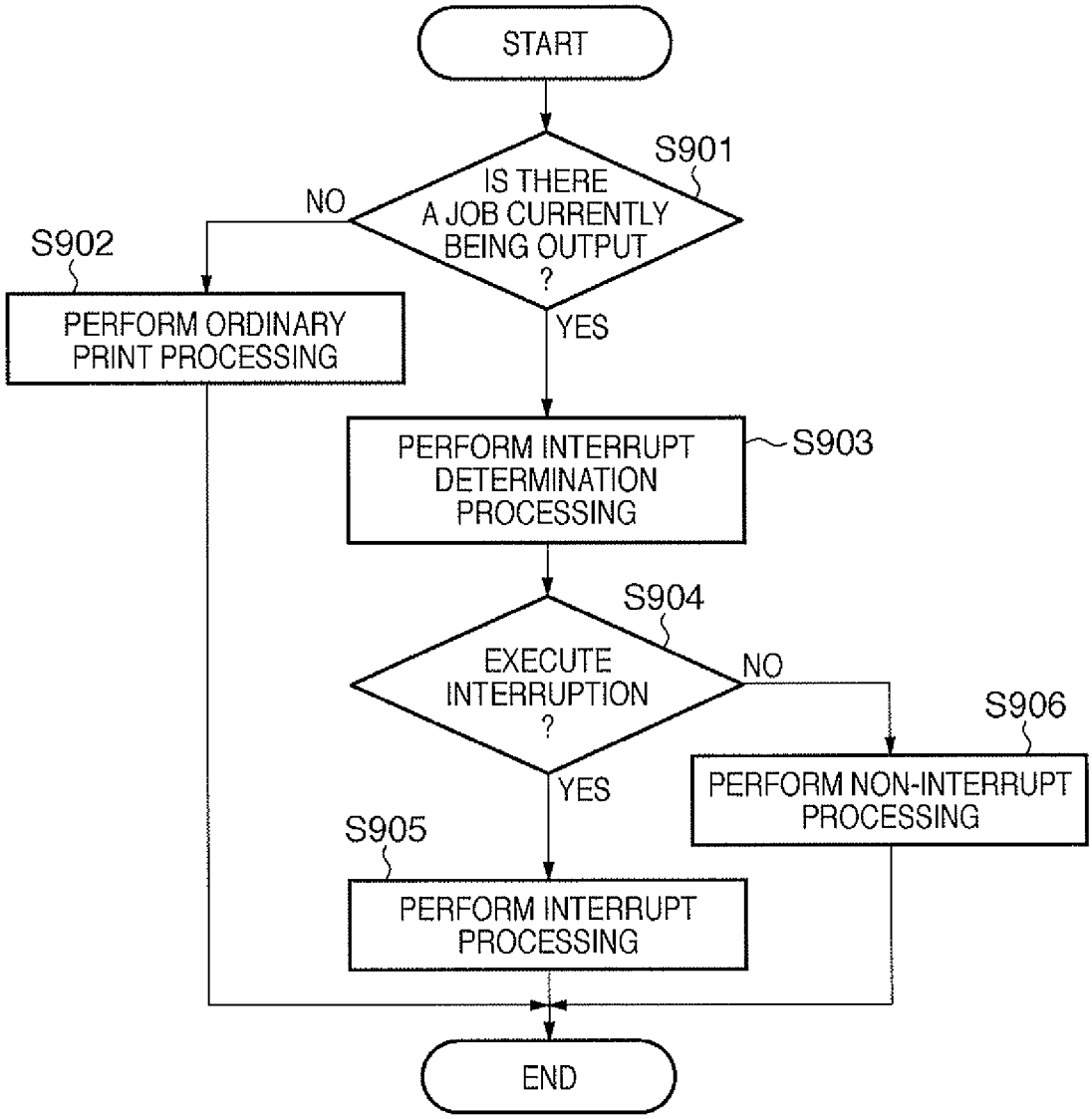
FIG. 6 is a flowchart that shows the flow of processing of a printing apparatus serving as an embodiment of the present invention.

Next is a basic description of an interrupt printing control method employing an interrupt permission table, with reference to the flowchart in FIG. 6. The steps shown in the flowchart in FIG. 6 are performed due to the control unit 205 executing a program stored in the ROM 207.

When the start key 503 has been pressed in a state in which use of the interrupt function has been designated by the user using the interrupt key 613, the control unit 205 executes the processing shown in the flowchart in FIG. 6.

In S901, the control unit 205 determines whether or not there is a job that is being executed. When there is not a job that is being executed, processing is advanced to S902, where the control unit 205 executes the print job designated to be performed with the interrupt function, and then ends processing. When the job that is executed is a copy job, the control unit 205 uses the printer unit 203 to print an image of an original that has been read by the scanner unit 201 based on copy settings received by the operating unit 204. When the job that is executed is a print job, the control unit 205 uses the printer unit 203 to print image data received from the external I/F 202, based on print settings received from the client computer 104.

When there is a job that is being executed in S901, processing is advanced to S903, where the control unit 205 refers to an interrupt permission table 7001*a*, an example of which is shown in FIG. 7, to determine whether or not to execute interrupt processing. The interrupt permission table 7001*a* includes a list of job combinations for which interruption is possible, for each type of interjected job and interrupted job. If a combination of the type of job being executed and the type of job to be interjected is present in the interrupt permission table 7001*a*, the control unit 205 executes interrupt processing S905. On the other hand, if a corresponding relationship does not exist, the control unit 205 executes non-interrupt processing S906.

For example, when a print job being executed is an ordinary job, and an interrupting job is also an ordinary job, a rule 1002 exists in the interrupt permission table 7001*a*. In this case, the control unit 205 determines to permit interrupt processing in S904. When a determination is made to permit interrupting execution in S904, the control unit 205 executes interrupt processing in S905. In this case, the control unit 205 temporarily stops the job currently being executed and executes the job instructed to be interjected. After executing the print job instructed to be interjected, the control unit 205 resumes execution of the job that was temporarily stopped.

Also, for example, when the print job currently being executed is a glosser pre-processing job and the interrupting job is also a glosser pre-processing job, a rule 1003 exists in the interrupt permission table 7001*a*. In this case, the control unit 205 determines to permit interrupt processing in S904. When a determination is made to permit interruption in S904, the control unit 205 executes interrupt processing in S905. In this case, the control unit 205 temporarily stops the glosser pre-processing job currently being executed and executes the glosser pre-processing job instructed to be interjected. After executing the glosser pre-processing job instructed to be interjected, the control unit 205 resumes execution of the glosser pre-processing job that was temporarily stopped.

On the other hand, when the job currently being executed is a glosser pre-processing job and the job instructed to be interjected is an ordinary job, a corresponding relationship does not exist in the interrupt permission table 7001*a*. Therefore, in S904, the control unit 205 determines that interrupt processing should not be executed. In this case processing is advanced from S904 to S906. In S906, interrupt processing is not performed, rather, the job instructed to be interjected is executed after finishing execution of the job currently being executed.

That is, the control unit 205 determines whether or not to permit interruption based on the type of job that is currently being executed and the type of job to be interjected. When there is a setting in the permission table to permit the job that is currently being executed to be interrupted by the job to be interjected, interrupt processing is permitted. On the other hand, when there is not a setting in the permission table to permit the job that is currently being executed to be interrupted by the job to be interjected, interrupt processing is prohibited.

When execution of an interrupt printing job is permitted based on the interrupt permission table, the control unit 205 temporarily stops execution of the job that is currently being executed, and starts execution of the interrupt printing job. The control unit 205 resumes execution of the stopped job after the interrupt printing job is completed.

In this way, the control unit 205 prohibits printing by interjecting a job for which the fixing unit temperature setting is different. Thus, it is possible to prevent a decrease in job production efficiency.

(Second Embodiment)

In the first embodiment, a case was described in which interruption is prohibited when the fixing unit temperature for a job that is currently being executed is different from the fixing unit temperature necessary to execute a job to be interjected.

In the second embodiment, an example is described in which job interrupt processing is prohibited when it is necessary to cool the fixing unit as a result of a job being interjected, and job interrupt processing is permitted when it is necessary to increase the fixing unit temperature. This second embodiment utilizes the fact that the time necessary for increasing the fixing unit temperature is shorter than the time necessary for cooling the fixing unit.

For example, it is assumed that while a glosser pre-processing job is being executed, a user has given an instruction to perform interrupt printing of a job that requires a higher fixing unit temperature than the glosser pre-processing job that is currently being executed. In this case, interrupt processing is permitted, so the user can quickly obtain output items of the interjected job.

Also a description will be given of control whereby when such interrupt processing is permitted, by rescheduling the execution order of jobs awaiting execution, the time until completion of execution of the job that is currently being executed and the jobs awaiting execution is shortened.

The configuration of the printing system 1000 is the same as described in the first embodiment with reference to FIGS. 1 to 5, so a detailed description of that configuration is omitted here. The control unit 205 executes processing according to the flowchart shown in FIG. 6. The second embodiment differs from the first embodiment with respect to the content of the interrupt permission table and the content of interrupt processing in S905.

First, a method for rescheduling jobs awaiting execution when interrupt processing has been executed will be described with reference to FIG. 8.

Figure 8:
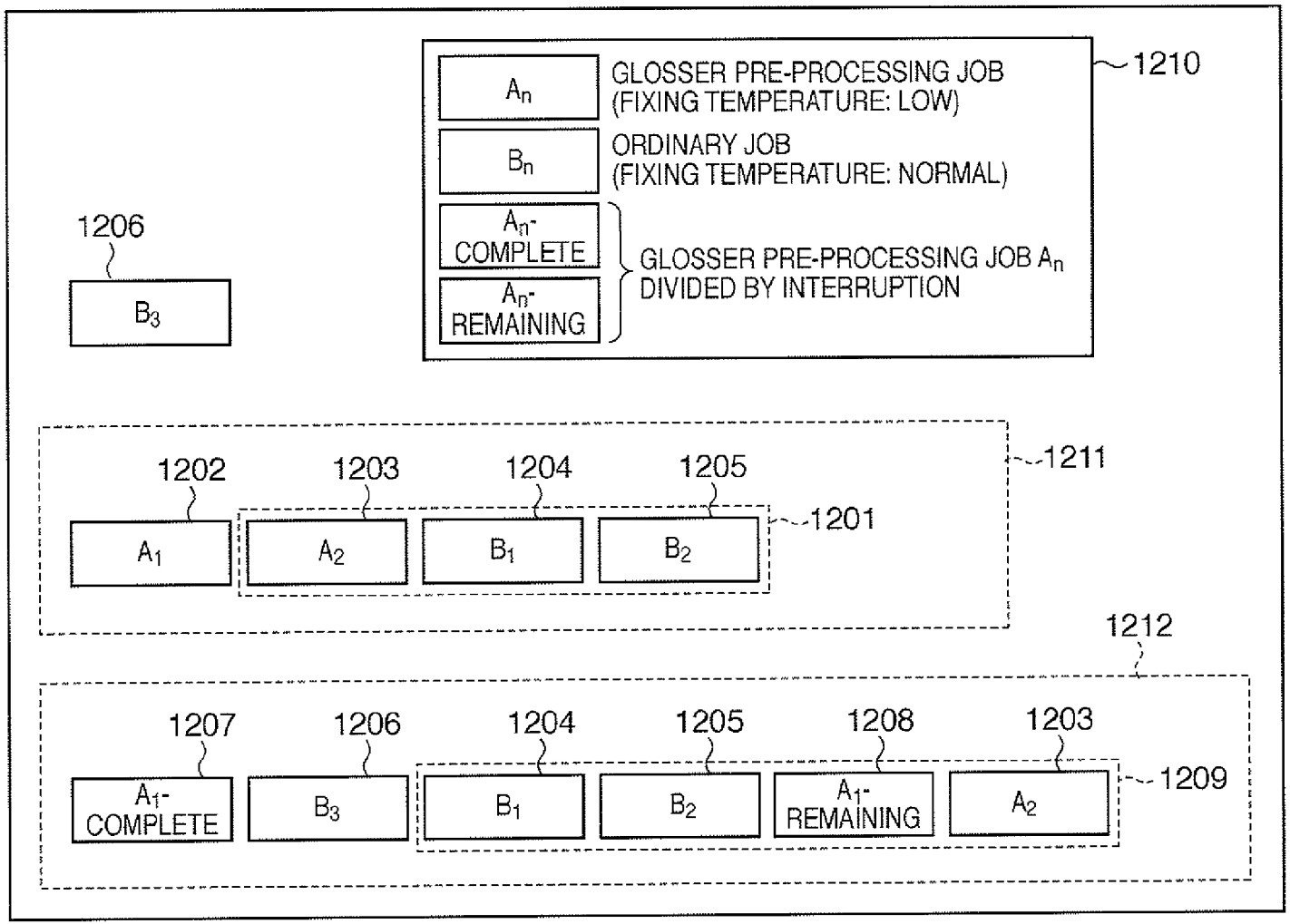
FIG. 8 shows examples of job scheduling in a printing apparatus serving as an embodiment of the present invention.

As denoted by reference numeral 1210 in FIG. 8, $A_n$ indicates a glosser pre-processing job and $B_n$ designates an ordinary job. $A_{n\text{-}compete}$ indicates a portion for which print processing is completed by the time that interrupt processing is executed in a print job A, and $A_{n\text{-}remaining}$ indicates a portion remaining as print processing when interrupt processing was executed in the print job A.

Reference numeral 1211 denotes the state of a queue in the printing system 1000 before interrupt processing is executed, and reference numeral 1212 denotes the state of the queue in the printing system 1000 after interrupt processing has been executed. The queue is an area provided in the HDD 209 where information regarding a job that is currently being executed and jobs awaiting execution is managed. The control unit 205 registers received jobs in the queue, and executes jobs in the order that they were registered. The jobs indicated by reference numerals 1211 and 1212 are executed in order from left to right in FIG. 8.

Within the queue denoted by reference numeral 1211, reference numeral 1201 denotes jobs that have been input to the printing system 1000 and are awaiting execution. Reference numeral 1202 denotes a job that has been input to the printing system 1000 and is currently being executed. After processing of the job 1202 that is currently being executed is completed, the control unit 205 executes the jobs awaiting execution in the order 1203, 1204, 1205.

When an interrupting job 1206 is input in such a state, the job 1202 that is currently being executed is detected, and based on the interrupt permission table, the control unit determines whether or not to permit interjection of a job.

Here, it is assumed that an interrupt permission table 7001*b* has been set as shown in FIG. 7. The control unit 205 determines to permit interjection of an ordinary job while a glosser pre-processing job is being executed, and executes interrupt processing.

Here, an interrupting job $B_3$ is an ordinary job, so the control unit 205 causes the fixing unit temperature to be increased to the temperature Ta for an ordinary job after execution of a glosser pre-processing job $A_{1\text{-}remaining}$. However, when the glosser pre-processing job $A_{1\text{-}remaining}$ is executed after completion of execution of the interrupting job $B_3$, it is necessary to return the fixing unit temperature to Tb. Therefore, it takes time to cool the fixing unit. Furthermore, after the glosser pre-processing job $A_{1\text{-}remaining}$ is executed, the glosser pre-processing job 1203 is executed, and thereafter it is necessary to set the fixing unit temperature to Ta. Therefore, it is necessary to adjust the fixing unit temperature a total of three times.

Consequently, in the present embodiment, control is performed as described below.

When an instruction to execute the interrupting job 1206 is received, the control unit 205 selects the jobs 1204 or 1205, which are of the same type as the interrupting job 1206, from among the jobs in a waiting state. After execution of the interrupting job 1206 is completed, the control unit 205 changes the execution order of the jobs awaiting execution such that the selected job can be executed next. As a result, the order of jobs awaiting execution is changed to 1204, 1205, 1208, 1203.

That is, when executing an interrupting job, the control unit 205 compares the type of the interrupting job, the interrupted job, and the jobs awaiting execution. Also, the control unit 205 changes the job execution order such that among the jobs awaiting execution, a job of the same type as the interrupting job is printed before a job of a different type than the interrupting job. The reason for this is that when jobs are of the same type, the fixing unit temperature necessary for execution of those respective jobs is the same or similar.

Thus, it is possible to reduce the frequency of changing the fixing unit temperature, thereby increasing job productivity efficiency.

(Other Embodiments)

The interrupt permission table described in the above embodiments may also be editable by a user. Thus, for example, the user can set whether control is performed based on the rules described in the first embodiment, or based on the rule described in the second embodiment.

Figure 9A:
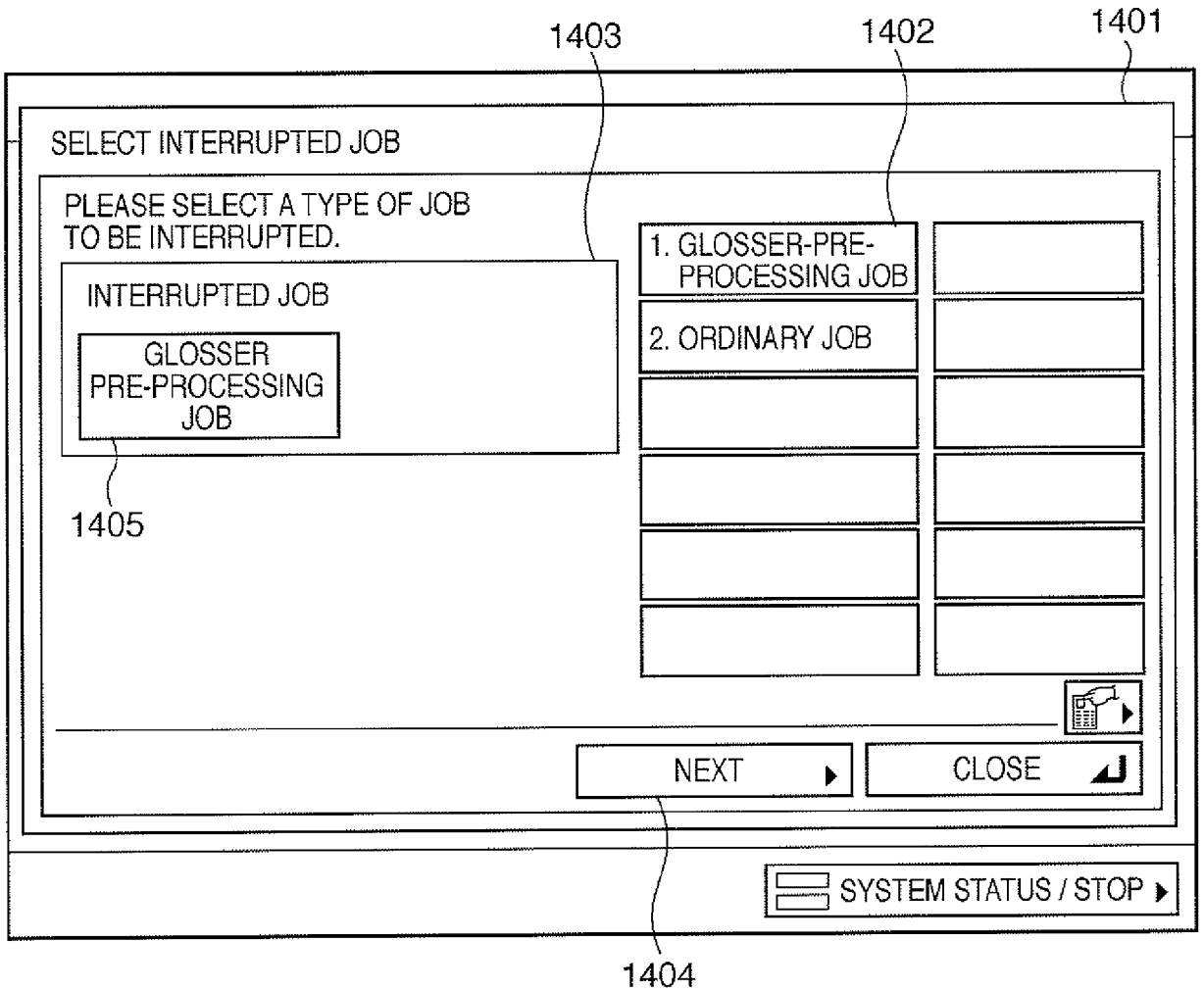
FIGS. 9A, 9B, and 9C show examples of a screen displayed in an operating unit of a printing apparatus serving as an embodiment of the present invention.
Figure 9B:
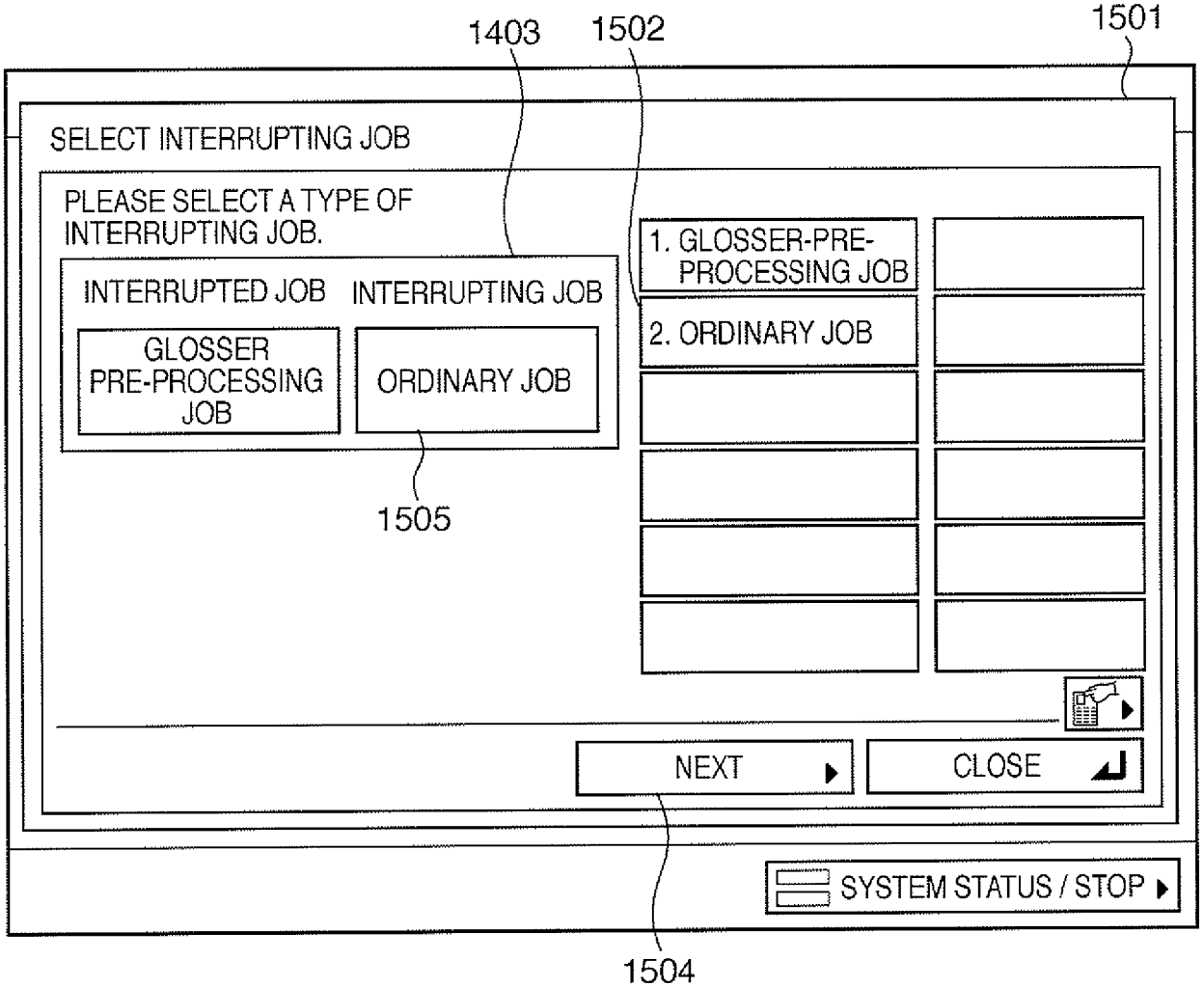
Figure 9C:
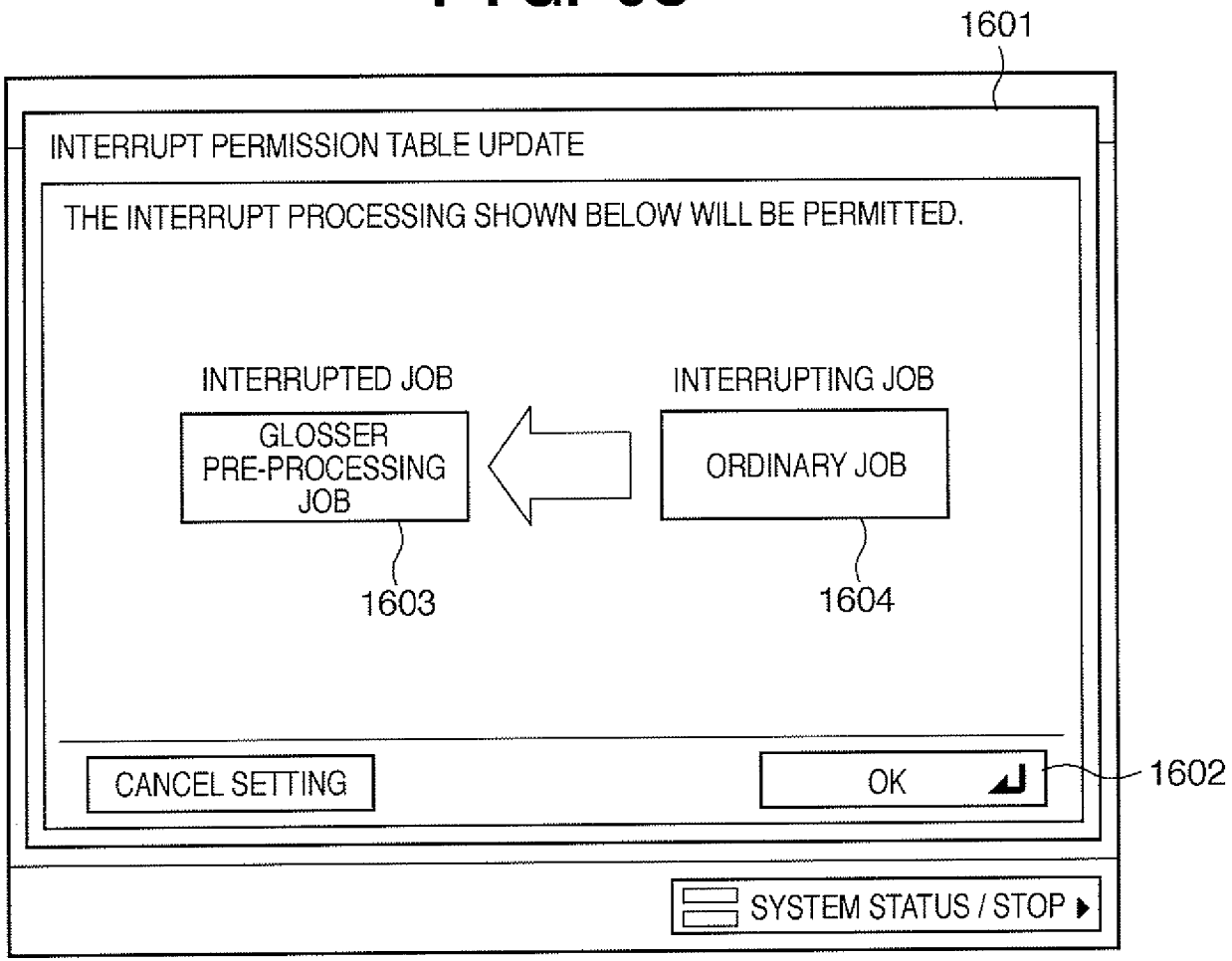

Specifically, following is a description of a method for adding rules to the interrupt permission table using a user interface, with reference to screens 1401, 1501, and 1601 in FIGS. 9A, 9B, and 9C. When permitting interjection of an ordinary job while a glosser pre-processing job is being executed, the user presses an interrupting job settings button 619 shown in FIG. 4. When the control unit 205 detects that the interrupting job settings button 619 has been pressed, the control unit 205 causes the operating unit 204 to display an interrupt settings screen 1401 for selecting a job to be interrupted. When the control unit 205 detects that a glosser pre-processing job button 1402 has been pressed on the interrupt settings screen 1401, the control unit 205 displays a glosser pre-processing job 1405 as an interrupted job in a job display area 1403 as indicated by the interrupt settings screen 1401 shown in FIG. 9A. Next, when the control unit 205 detects that a next button 1404 has been pressed, the control unit 205 controls the operating unit 204 to display the interrupt settings screen for selecting a job to be interjected.

When the control unit 205 detects that an ordinary job button 1502 has been pressed on the interrupt settings screen 1501 shown in FIG. 9B, the control unit 205 displays an ordinary job 1505 as an interrupting job in the job display area 1403. After selection of the interrupting job, when the control unit 205 detects that a next button 1504 has been pressed, the control unit 205 causes the operating unit 204 to display an interrupt settings confirmation screen 1601 shown in FIG. 9C. In this example, the interrupt settings confirmation screen 1601 is a screen for causing the user to confirm that now settings will be set to permit interjection of an ordinary job while a glosser pre-processing job is being executed. When the user presses an OK button 1602 to permit this interjection, the control unit 205 registers a setting 1004 in the interrupt permission table 7001*b*. When the state of the permission table before registering the setting 1004 is as indicated in the interrupt permission table 7001*a* in FIG. 7, the state of the permission table after registration of the setting 1004 is a combination of the interrupt permission tables 7001*a* and 7001*b* in FIG. 7.

Also, in the above embodiments, the relationship of glosser pre-processing jobs and ordinary jobs is registered and defined in the interrupt permission table, and the control unit 205 determines whether or not to permit interruption based on this permission table. However, this method is not a limitation; the control unit 205 may also perform control as follows.

A fixing unit temperature necessary for job execution is stored for each job type in the HDD 209, and the control unit 205 specifies a difference between the fixing unit temperature necessary for a job that is currently being executed and the fixing unit temperature that is necessary for a job to be interjected. When the difference between the fixing unit temperature necessary for the job that is currently being executed and the fixing unit temperature that is necessary for the job to be interjected is at least a predetermined value, the control unit 205 prohibits interrupt processing, and when less than the predetermined value, the control unit 205 permits interrupt processing. For example, it is assumed that the type of sheet used for the job that is currently being executed is plain paper, and the type of sheet used for the job to be interjected is heavy paper. In this case, the control unit 205 sets settings such that the fixing unit temperature is higher for job in which a recording agent (toner) is fixed to heavy paper than for a job in which the recording agent is fixed to plain paper. However, in this case, the difference between the fixing unit temperature that is necessary for execution of the job using plain paper and the fixing unit temperature that is necessary for execution of the job using heavy paper is less than the above-described difference between an ordinary job and a glosser pre-processing job. Therefore, when performing interrupting execution of a job using heavy paper while a job using plain paper is being executed, the control unit 205 performs the following sort of control. The control unit 205 permits interrupt processing when it has detected that the difference between the fixing unit temperature that is necessary for execution of a job using plain paper and the fixing unit temperature that is necessary for execution of a job using heavy paper is less than a predetermined value. Also, the control unit 205 may perform the following sort of control. The control unit 205 permits execution of interrupt processing when, during execution of a particular job, a job is interjected in which the type of sheet used is different than in that job. On the other hand, the control unit 205 prohibits interruption when, during execution of a particular job, a job is interjected in which glosser pre-processing, is a different type of processing than in that job, is performed. Thus, the control unit 205 can determine whether or not to permit interrupt processing based on the type of the interrupted job and the interrupting job.

Also, a configuration may be adopted in which the user can set settings such that both interjection of a job of a different type of processing and interjection of a job using a different type of sheet are prohibited. In this case, the control unit 205 performs control such that interrupt processing is not permitted unless the type of processing is the same and also the type of sheet is the same for both jobs. Thus, in addition to shortening a delay that occurs due to a glosser pre-processing job interrupting an ordinary job, it is possible to shorten a delay that occurs due to performing interrupting execution of another job having a different sheet type.

Figure 10A:
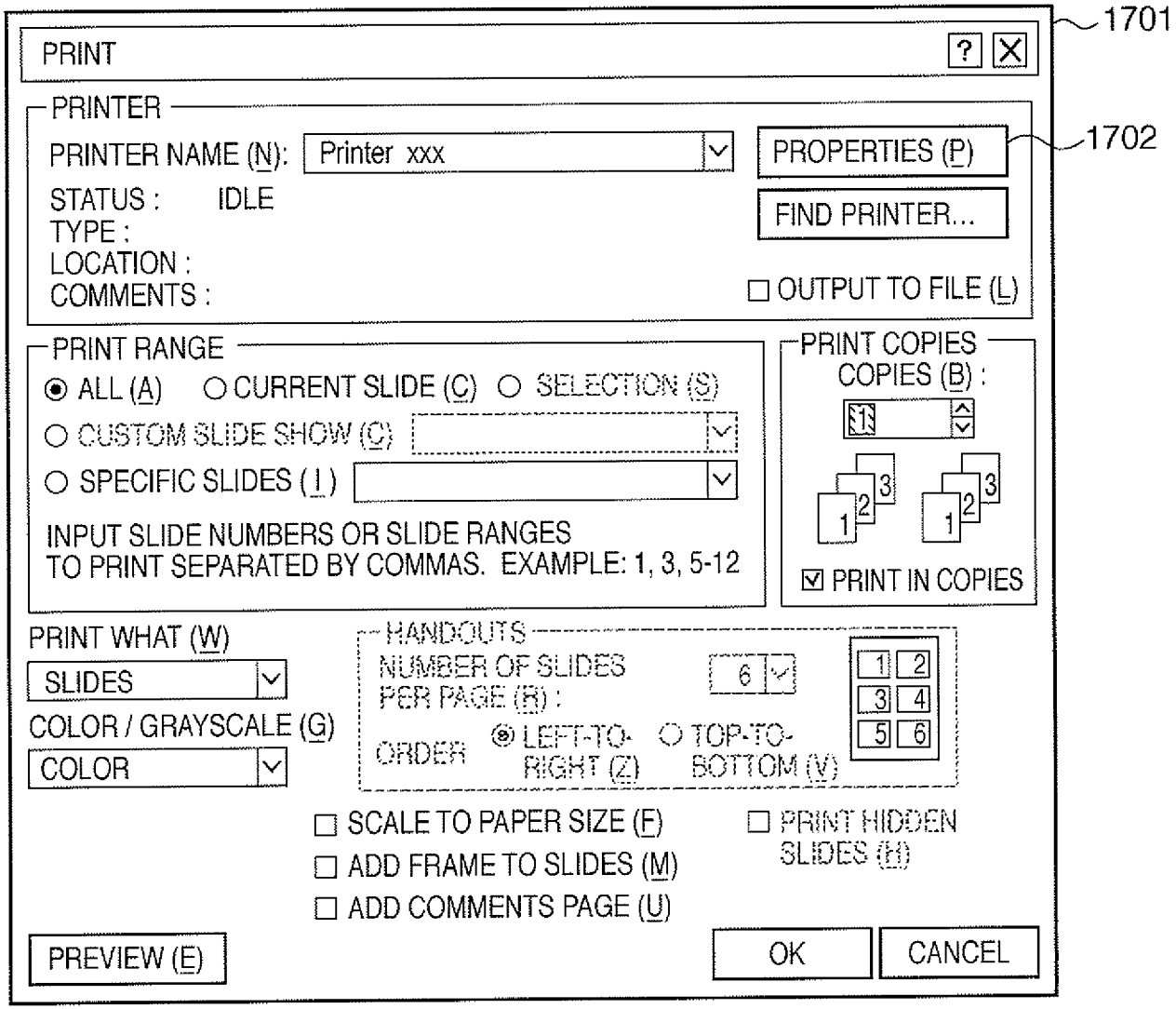
FIGS. 10A and 10B show examples of a screen displayed in an operating unit of a printing apparatus serving as an embodiment of the present invention.
Figure 10B:
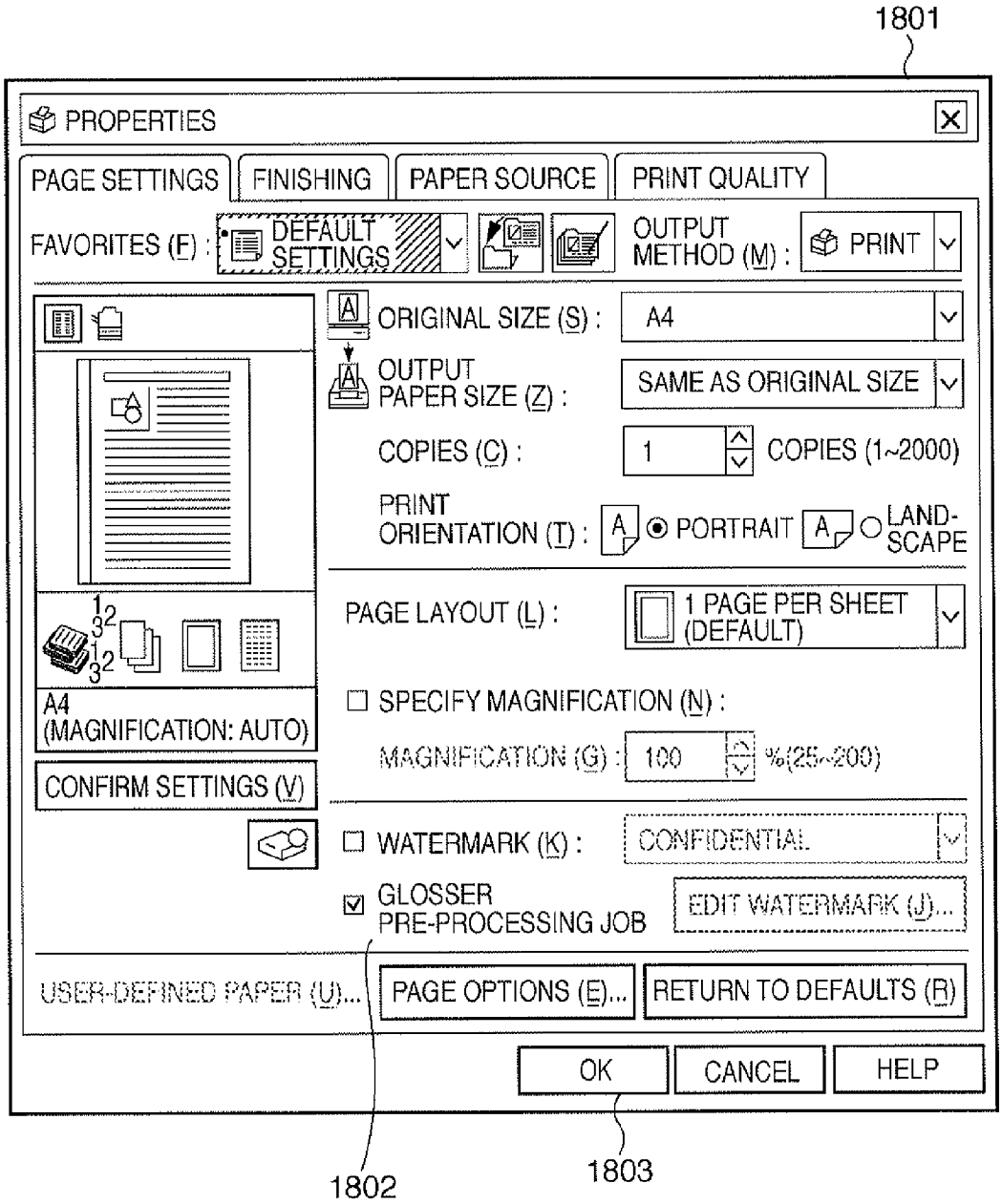

Next is a description of a case in which glosser pre-processing is executed from the server computer 103 or the client computer 104, with reference to FIGS. 10A and 10B. When an instruction to print data created using software such as an application is received from a user, the server computer 103 or the client computer 104 displays a print settings screen 1701. In the print settings screen 1701, when detected that a properties button 1702 has been pressed, the server computer 103 or the client computer 104 displays a print properties screen 1801.

When the user enters a check in a glosser pre-processing job check box 1802 and then presses an OK button 1803, the server computer 103 or the client computer 104 inputs a job in which glosser pre-processing is performed to the printing apparatus 100. Thus, in the above embodiments, the user can cause the printing system 1000 to execute a glosser pre-processing job. Also, it is possible for the printing system 1000 to recognize that glosser pre-processing of data received from the server computer 103 or the client computer 104 should be executed.

According to the above embodiments, it is possible to effectively control interrupt printing jobs, and thus increase overall printing throughput. That is, it is possible to provide a scheme whereby it is possible to shorten the overall processing time of jobs including interrupt printing processing, and also having a high degree of flexibility and convenience. Specifically, by interrupting a job that is currently being executed to print a job that requires a different fixing unit temperature than the job that is currently being executed, it is possible to suppress a reduction in job productivity.

Above embodiments of the present invention are described in detail, but the present invention may also be applied to a system comprised of a plurality of devices, or may be applied to an apparatus comprised of a single device. Also, in the above embodiments, the printing apparatus 100 is described as an example of printing control apparatus, however the printing control apparatus may also be an apparatus that does not include a printing unit that performs printing using a fixing unit in the manner of the printing apparatus 100, but causes the printing unit to perform printing. Also, the printing control apparatus may be a printing system 1000 including a printing apparatus 100 that has a printing unit.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-025097, filed Feb. 5, 2009, which is hereby incorporated by reference herein in its entirety.

What is claimed is:

1. A printing control apparatus that causes printing by a printing unit having a fixing unit that fixes a recording agent on a sheet, the printing control apparatus comprising:

a printing control unit configured to cause the printing unit to stop printing of a current printing job, and print another job in a state that printing of the current printing job has been stopped; and a determining unit configured to determine whether or not to permit execution of the other job in a state that the printing of the current printing job has been stopped by the printing control unit, based on a first fixing unit temperature set in accordance with a type of processing specified in the current printing job and a second fixing unit temperature set in accordance with a type of processing specified in the other job;

wherein the printing control unit performs control such that the other job is executed in a state that the current printing job has been stopped when the determining unit determines to permit execution of the other job in a state that the current printing job has been stopped, and wherein the other job is not executed in a state that the current printing job has been stopped when the determining unit determines not to permit execution of the other job in a state that the current printing job has been stopped.

2. The printing control apparatus according to claim 1, wherein the determining unit determines not to permit execution of the other job in a state that the current printing job has been stopped by the printing control unit in a case that the difference between the first fixing unit temperature set in accordance with the type of processing specified in the current printing job and the second fixing unit temperature set in accordance with the type of processing specified in the other job is more than a predetermined value, and determines to permit execution of the other job in a state that the current printing job has been stopped by the printing control unit in a case that the difference between the first fixing unit temperature set in accordance with the type of processing specified in the current printing job and the second fixing unit temperature set in accordance with the type of processing specified in the other job is not more than the predetermined value.

3. The printing control apparatus according to claim 1, further comprising:

a holding unit configured to hold a plurality of jobs to be executed; and a specifying unit configured to specify a job that can be executed at a fixing unit temperature that is near the first fixing unit temperature set in accordance with the type of processing specified in the stopped job from among the plurality of jobs held by the holding unit;

wherein when the printing control unit stops printing of the current printing job, and causes the printing unit to print another job in a state that printing of the current printing job is stopped, the printing control unit executes the job specified by the specifying unit from among the jobs held by the holding unit after execution of the other job, and before other jobs held in the holding unit.

4. The printing control apparatus according to claim 1, further comprising a storage unit configured to store information that indicates whether or not to permit execution of the other job in a state that the current printing job has been stopped by the printing control unit, wherein the printing control unit determines whether or not to permit execution of the other job in a state that the current printing job has been stopped based on the information stored in the storage unit.

5. The printing control apparatus according to claim 4, further comprising a changing unit configured to be capable of changing the information stored in the storage unit that indicates whether or not to permit execution of the other job in a state that the current printing job has been stopped by the printing control unit, according to operation by a user.

6. A method for performing printing control to cause printing by a printing unit having a fixing unit that fixes a recording agent on a sheet, the method comprising:

a printing control step of causing the printing unit to stop printing of a current printing job, and to print another job in a state that printing of the current printing job has been stopped; and a determining step of determining whether or not to permit execution of the other job in a state that the printing of the current printing job has been stopped in the printing control step, based on a first fixing unit temperature set in accordance with a type of processing specified in the current printing job and a second fixing unit temperature set in accordance with a type of processing specified in the other job;

wherein in the printing control step, control is performed such that the other job is executed in a state that the current printing job has been stopped when a determination has been made in the determining step to permit execution of the other job in a state that the current printing job has been stopped, and wherein the other job is not executed in a state that the current printing job has been stopped when a determination has been made in the determining step not to permit execution of the other job in a state in which the current printing job has been stopped.

7. A non-transitory computer readable storage medium storing a program for causing a computer to execute the method for performing printing control according to claim 6.

8. A printing control apparatus that causes printing by a printing unit having a fixing unit that fixes a recording agent on a sheet, the printing control apparatus comprising:

a printing control unit configured to cause the printing unit to stop printing of a current printing job, and print another job in a state that printing of the current printing job has been stopped; and a determining unit configured to permit the execution of the other job in a state that the current printing job has been stopped by the printing control unit in a case that both the current printing job and the other job are processed by the fixing unit at the same temperature, and not to permit the execution of the other job in a state that the current printing job has been stopped by the printing control unit in a case that the current printing job and the other job are processed by the fixing unit at different temperatures;

wherein the printing control unit performs control such that the other job is executed in a state that the current printing job has been stopped when the determining unit determines to permit execution of the other job in a state that the current printing job has been stopped, and wherein the other job is not executed in a state that the current printing job has been stopped when the determining unit determines not to permit execution of the other job in a state that the current printing job has been stopped.

9. The printing control apparatus according to claim 8, wherein the determining unit permits the execution of the other job in a state that the current printing job has been stopped by the printing control unit in a case that a type of the current printing job is the same as a type of the other job, and does not permit the execution of the other job in a state that the current printing job has been stopped by the printing control unit in a case that the type of the current printing job is different from the type of the other job.

10. A method for performing printing control to cause printing by a printing unit having a fixing unit that fixes a recording agent on a sheet, the method comprising:

a printing control step of causing the printing unit to stop printing of a current printing job, and to print another job in a state that printing of the job has been stopped; and a determining step of permitting the execution of the other job in a state that the current printing job has been stopped in a case that both the current printing job and the other job are processed by the fixing unit at the same temperature, and not permitting the execution of the other job in a state that the current printing job has been stopped in a case that the current printing job and the other job are processed by the fixing unit at different temperatures;

wherein in the printing control step, control is performed such that the other job is executed in a state that the current printing job has been stopped when a determination has been made in the determining step to permit execution of the other job in a state that the current printing job has been stopped, and wherein the other job is not executed in a state that the current printing job has been stopped when a determination has been made in the determining step not to permit execution of the other job in a state in which the current printing job has been stopped.

11. A non-transitory computer readable storage medium storing a program for causing a computer to execute the method for performing printing control according to claim 10.

* * * * *